US008989401B2

(12) United States Patent
Ojanperä

(10) Patent No.: US 8,989,401 B2
(45) Date of Patent: Mar. 24, 2015

(54) AUDIO ZOOMING PROCESS WITHIN AN AUDIO SCENE

(75) Inventor: Juha Ojanperä, Nokia (FI)

(73) Assignee: Nokia Corporation, Espoo (FI)

( * ) Notice: Subject to any disclaimer, the term of this patent is extended or adjusted under 35 U.S.C. 154(b) by 377 days.

(21) Appl. No.: 13/509,262

(22) PCT Filed: Nov. 30, 2009

(86) PCT No.: PCT/FI2009/050962

§ 371 (c)(1),
(2), (4) Date: May 10, 2012

(87) PCT Pub. No.: WO2011/064438

PCT Pub. Date: Jun. 3, 2011

(65) Prior Publication Data

US 2012/0230512 A1 Sep. 13, 2012

(51) Int. Cl.
*H04R 3/00* (2006.01)
*H04S 7/00* (2006.01)

(52) U.S. Cl.
CPC *H04R 3/00* (2013.01); *H04S 7/302* (2013.01); *H04S 2400/03* (2013.01); *H04S 2400/15* (2013.01)
USPC ..... 381/92

(58) Field of Classification Search
CPC .. H04R 3/005; H04R 1/406; H04R 2201/401; H04R 2201/403; H04R 25/407
USPC ..... 371/92; 381/92
See application file for complete search history.

(56) References Cited

U.S. PATENT DOCUMENTS

| | | | | |
|---|---|---|---|---|
| 6,469,732 | B1 * | 10/2002 | Chang et al. | 348/14.08 |
| 6,522,325 | B1 * | 2/2003 | Sorokin et al. | 345/427 |
| 6,931,138 | B2 | 8/2005 | Kawamura et al. | |
| 7,099,821 | B2 * | 8/2006 | Visser et al. | 704/226 |
| 7,319,769 | B2 * | 1/2008 | Allegro-Baumann et al. | 381/312 |
| 7,728,870 | B2 * | 6/2010 | Rudnik et al. | 348/143 |
| 7,876,914 | B2 * | 1/2011 | Grosvenor et al. | 381/92 |
| 7,995,768 | B2 * | 8/2011 | Miki et al. | 381/59 |
| 8,098,841 | B2 * | 1/2012 | Sawara et al. | 381/83 |
| 8,204,247 | B2 * | 6/2012 | Elko et al. | 381/92 |
| 8,340,306 | B2 * | 12/2012 | Faller | 381/23 |
| 2004/0111171 | A1 | 6/2004 | Jang | |
| 2005/0281410 | A1 | 12/2005 | Grosvenor et al. | |
| 2006/0008117 | A1 | 1/2006 | Kanada | |

(Continued)

FOREIGN PATENT DOCUMENTS

| | | |
|---|---|---|
| WO | 2009109217 | 9/2009 |
| WO | 2009123409 | 10/2009 |

OTHER PUBLICATIONS

Extended European Search Report received for corresponding European Patent Application No. 09851595.0, dated Apr. 3, 2013, 7 pages.

(Continued)

*Primary Examiner* — Simon Sing
(74) *Attorney, Agent, or Firm* — Alston & Bird LLP

(57) ABSTRACT

A method comprising: obtaining a plurality of audio signals originating from a plurality of audio sources in order to create an audio scene; analyzing the audio scene in order to determine zoomable audio points within the audio scene; and providing information regarding the zoomable audio points to a client device for selecting.

18 Claims, 5 Drawing Sheets

(56) References Cited

U.S. PATENT DOCUMENTS

| | | | | |
|---|---|---|---|---|
| 2007/0298597 | A1 | 12/2007 | Saino | |
| 2008/0247567 | A1 | 10/2008 | Kjolerbakken et al. | |
| 2008/0298597 | A1 | 12/2008 | Turku et al. | |
| 2009/0110225 | A1 * | 4/2009 | Kim | 381/356 |
| 2010/0119072 | A1 | 5/2010 | Ojanpera | |

OTHER PUBLICATIONS

International Search Report received for corresponding Patent Cooperation Treaty Application No. PCT/FI2009/050962, dated Nov. 11, 2010, 5 pages.

Supplementary European Search Report and Search Opinion for corresponding European Patent Application No. EP09851595, dated Mar. 22, 2013, 2 pages.

Written Opinion received for corresponding Patent Cooperation Treaty Application No. PCT/FI2009/050962, dated Nov. 11, 2010, 8 pages.

International Preliminary Report on Patentability received for corresponding Patent Cooperation Treaty Application No. PCT/FI2009/050962, dated Jun. 5, 2012, 9 pages.

Olli Santala; "Perception of Spatially Distributed Sound Sources", Hesinki University of Technology Master's Thesis, May 22, 2009, retrieved from the Internet <URL: http:lib.tkk.fi/Dipl/2009/urn100034.pdf>.

* cited by examiner

AUDIO ZOOMING PROCESS WITHIN AN AUDIO SCENE

RELATED APPLICATION

This application was originally filed as PCT Application No. PCT/FI2009/050962 filed Nov. 30, 2009.

FIELD OF THE INVENTION

The present invention relates to audio scenes, and more particularly to an audio zooming process within an audio scene.

BACKGROUND OF THE INVENTION

An audio scene comprises a multi dimensional environment in which different sounds occur at various times and positions. An example of an audio scene may be a crowded room, a restaurant, a forest scene, a busy street or any indoor or outdoor environment where sound occurs at different positions and times.

Audio scenes can be recorded as audio data, using directional microphone arrays or other like means. FIG. 1 provides an example of a recording arrangement for an audio scene, wherein the audio space consists of N devices that are arbitrarily positioned within the audio space to record the audio scene. The captured signals are then transmitted (or alternatively stored for later consumption) to the rendering side where the end user can select the listening point based on his/her preference from the reconstructed audio space. The rendering part then provides a downmixed signal from the multiple recordings that correspond to the selected listening point. In FIG. 1, the microphones of the devices are shown to have a directional beam, but the concept is not restricted to this and embodiments of the invention may use microphones having any form of suitable beam. Furthermore, the microphones do not necessarily employ a similar beam, but microphones with different beams may be used. The downmixed signal may be a mono, stereo, binaural signal or it may consist of multiple channels.

Audio zooming refers to a concept, where an end-user has the possibility to select a listening position within an audio scene and listen to the audio related to the selected position instead of listening to the whole audio scene. However, throughout a typical audio scene the audio signals from the plurality of audio sources are more or less mixed up with each other, possibly resulting in noise-like sound effect, while on the other hand there are typically only a few listening positions in an audio scene, wherein a meaningful listening experience with distinctive audio sources can be achieved. Unfortunately, so far there has been no technical solution for identifying these listening positions, and therefore the end-user has to find a listening position providing a meaningful listening experience on trial-and-error basis, thus possibly giving a compromised user experience.

SUMMARY OF THE INVENTION

Now there has been invented an improved method and technical equipment implementing the method, by which specific listening positions can be determined and indicated for an end-user more accurately to enable improved listening experience. Various aspects of the invention include methods, apparatuses and computer programs, which are characterized by what is stated in the independent claims. Various embodiments of the invention are disclosed in the dependent claims.

According to a first aspect, a method according to the invention is based on the idea of obtaining a plurality of audio signals originating from a plurality of audio sources in order to create an audio scene; analyzing the audio scene in order to determine zoomable audio points within the audio scene; and providing information regarding the zoomable audio points to a client device for selecting.

According to an embodiment, the method further comprises in response to receiving information on a selected zoomable audio point from the client device, providing the client device with an audio signal corresponding to the selected zoomable audio point.

According to an embodiment, the step of analyzing the audio scene further comprises deciding the size of the audio scene; dividing the audio scene into a plurality of cells; determining, for the cells comprising at least one audio source, at least one directional vector of an audio source for a frequency band of an input frame; combining, within each cell, directional vectors of a plurality of frequency bands having deviation angle less than a predetermined limit into one or more combined directional vectors; and determining intersection points of the combined directional vectors of the audio scene as the zoomable audio points.

According to a second aspect, there is provided a method comprising: receiving, in a client device, information regarding zoomable audio points within an audio scene from a server; representing the zoomable audio points on a display to enable selection of a preferred zoomable audio point; and in response to obtaining an input regarding a selected zoomable audio point, providing the server with information regarding the selected zoomable audio point.

The arrangement according to the invention provides enhanced user experience due to interactive audio zooming capability. In other words, the invention provides additional element to the listening experience by enabling audio zooming functionality for the specified listening position. The audio zooming enables the user to move the listening position based on zoomable audio points to focus more on the relevant sound sources in the audio scene rather than the audio scene as such. Furthermore, a feeling of immersion can be created when the listener has the opportunity to interactively change/zoom his/her listening point in the audio scene.

Further aspects of the invention include apparatuses and computer program products implementing the above-described methods.

These and other aspects of the invention and the embodiments related thereto will become apparent in view of the detailed disclosure of the embodiments further below.

LIST OF DRAWINGS

In the following, various embodiments of the invention will be described in more detail with reference to the appended drawings, in which FIG. 1 shows an example of an audio scene with N recording devices.

Figure 6:
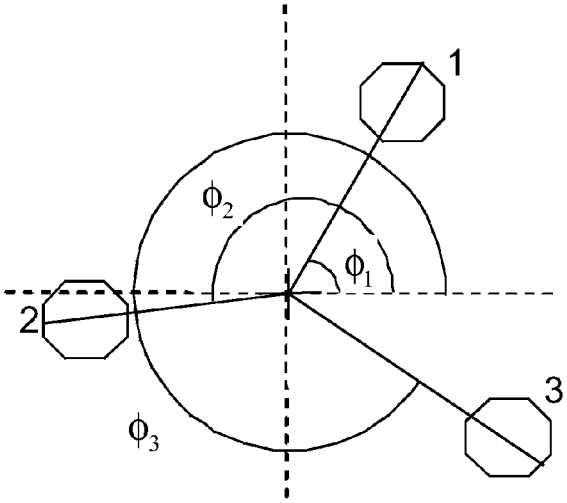
Figure 7:
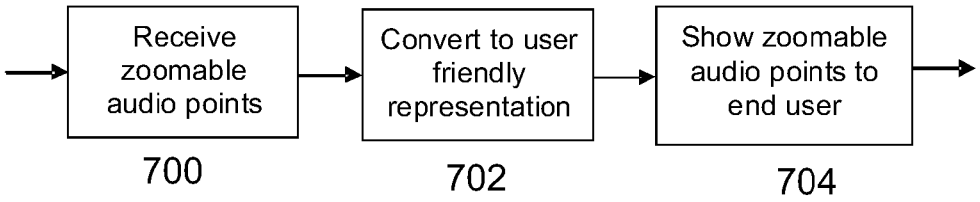
Figure 8:
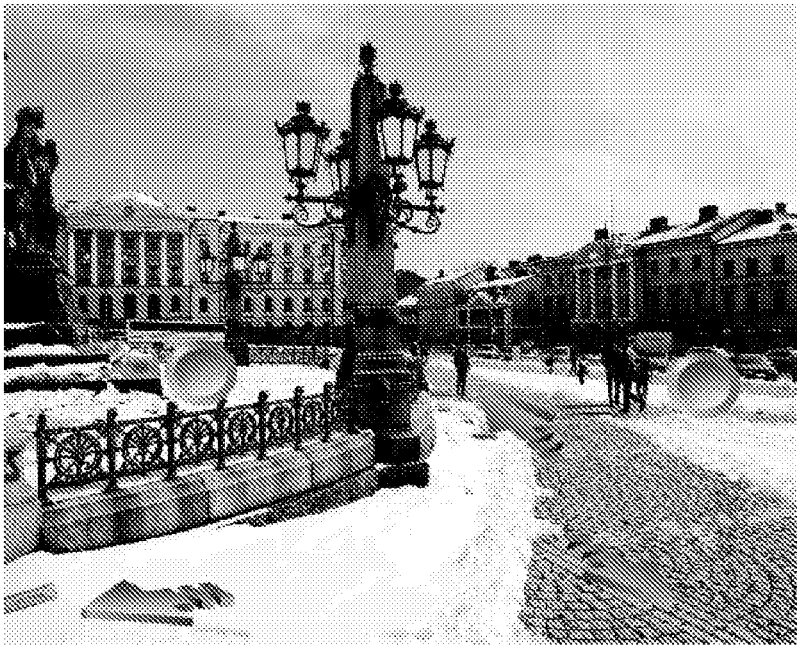
Figure 9:
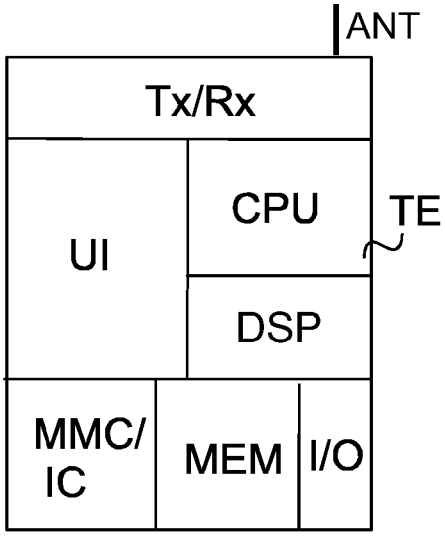

FIGS. 5*a*-5*d* illustrate the processing steps to obtain the zoomable audio points according to an embodiment of the invention;

FIG. 6 illustrates an example of the determination of the recording angle;

FIG. 7 shows the block diagram of a client device operation according to an embodiment of the invention;

FIG. 8 illustrates an example of end user representation of the zoomable audio points; and FIG. 9 shows simplified block diagram of an apparatus capable of operating either as a server or a client device in the system according to the invention.

DESCRIPTION OF EMBODIMENTS

Figure 1:
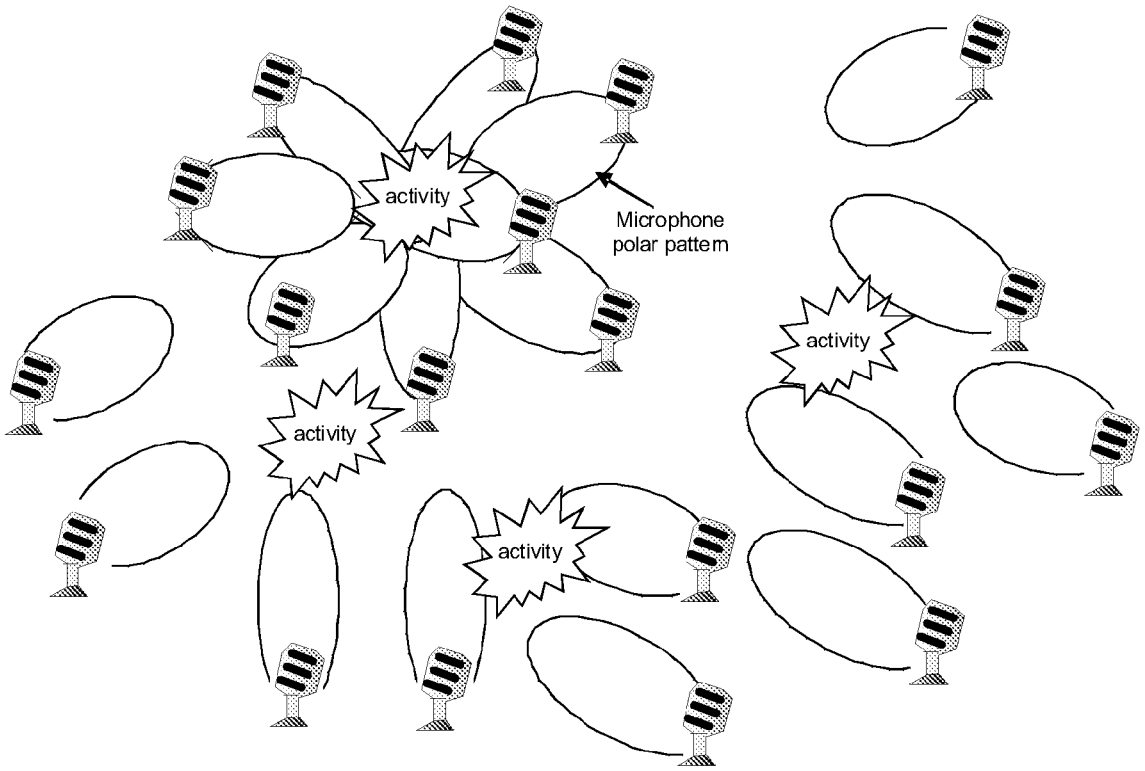
Figure 2:
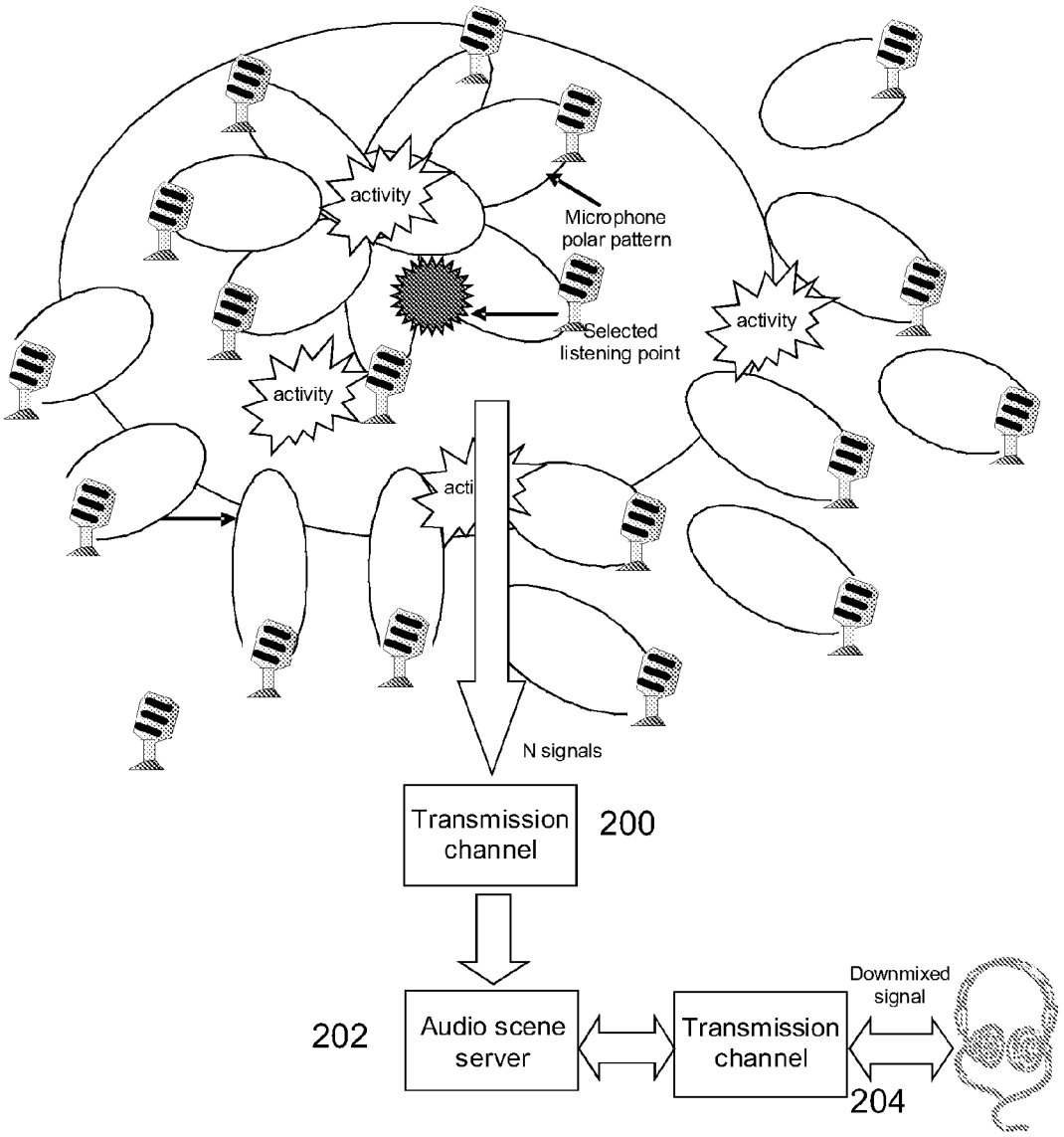
FIG. 2 shows an example of a block diagram of the end-to-end system.

FIG. 2 illustrates an example of an end-to-end system implemented on the basis of the multi-microphone audio scene of FIG. 1, which provides a suitable framework for the present embodiments to be implemented. The basic framework operates as follows. Each recording device captures an audio signal associated with the audio scene and transfers, for example uploads or upstreams the captured (i.e. recorded) audio content to the audio scene server 202, either real time or non-real time manner via a transmission channel 200. In addition to the captured audio signal, also information that enables determining the information regarding the position of the captured audio signal is preferably included in the information provided to the audio scene server 202. The information that enables determining the position of the respective audio signal may be obtained using any suitable positioning method, for example, using satellite navigation systems, such as Global Positioning System (GPS) providing GPS coordinates.

Preferably, the plurality of recording devices are located at different positions but still in close proximity to each other. The audio scene server 202 receives the audio content from the recording devices and keeps track of the recording positions. Initially, the audio scene server may provide high level coordinates, which correspond to locations where audio content is available for listening, to the end user. These high level coordinates may be provided, for example, as a map to the end user for selection of the listening position. The end user is responsible for determining the desired listening position and providing this information to the audio scene server. Finally, the audio scene server 202 transmits the signal 204, determined for example as downmix of a number of audio signals, corresponding to the specified location to the end user.

Figure 3:
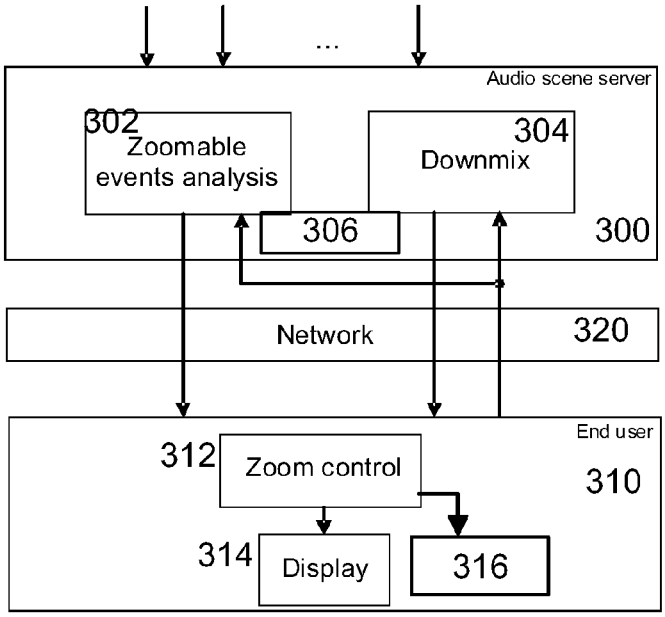
FIG. 3 shows an example of high level block diagram of the system in end-to-end context providing a framework for the embodiments of the invention.

FIG. 3 shows an example of a high level block diagram of the system in which the embodiments of the invention may be provided. The audio scene server 300 includes, among other components, a zoomable events analysis unit 302, a downmix unit 304 and a memory 306 for providing information regarding the zoomable audio points to be accessible via a communication interface by a client device. The client device 310 includes, among other components, a zoom control unit 312, a display 314 and audio reproduction means 316, such as loudspeakers and/or headphones. The network 320 provides the communication interface, i.e. the necessary transmission channels between the audio scene server and the client device. The zoomable events analysis unit 302 is responsible for determining the zoomable audio points in the audio scene and providing information identifying these points to the rendering side. The information is at least temporarily stored in the memory 306, wherefrom the audio scene server may transmit the information to the client device, or the client device may retrieve the information from the audio scene server.

The zoom control unit 312 of the client device then maps these points to a user friendly representation preferably on the display 314. The user of the client device then selects a listening position from the provided zoomable audio points, and the information of the selected listening position is provided, e.g. transmitted, to the audio scene server 300, thereby initiating the zoomable events analysis. In the audio scene server 300, the information of the selected listening position is provided to the downmix unit 304, which generates a downmixed signal that corresponds to the specified location in the audio scene, and also to the zoomable events analysis unit 302, which determines the audio points in the audio scene that provide zoomable events.

Figure 4:
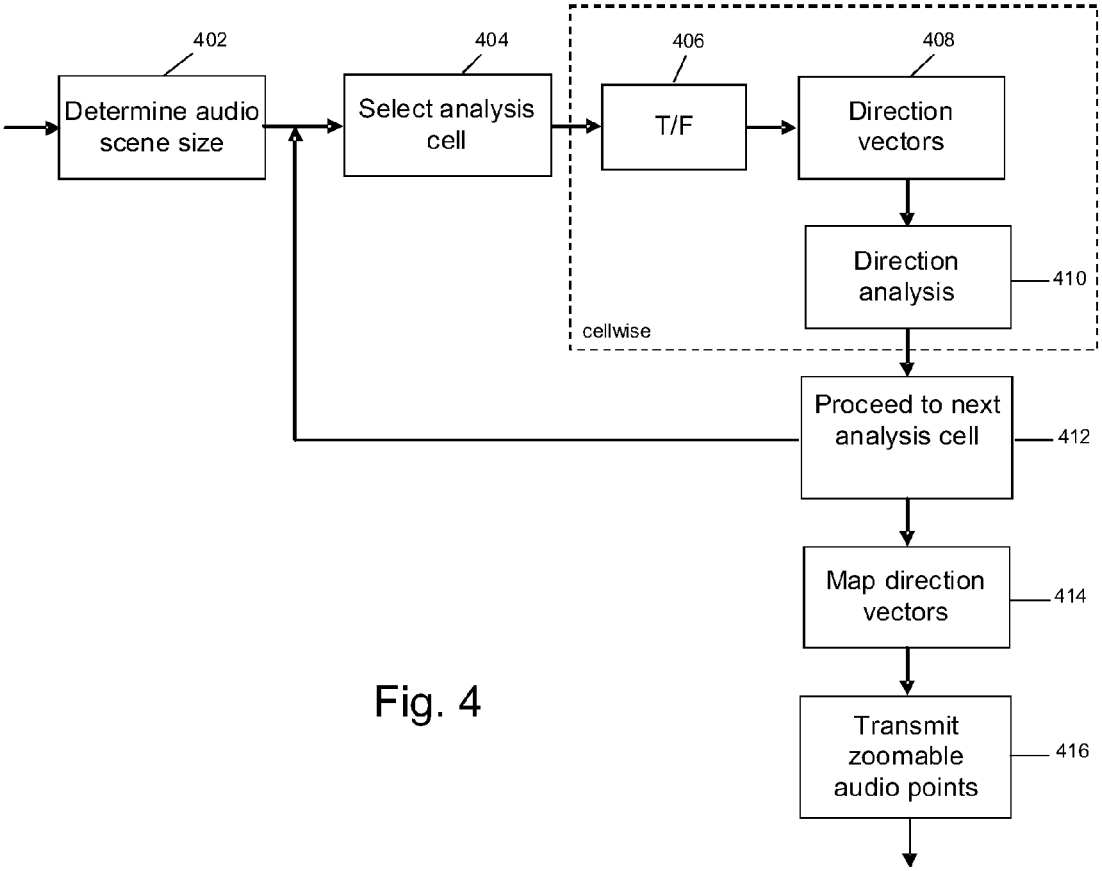
FIG. 4 shows a block diagram of the zoomable audio analysis according to an embodiment of the invention.
Figure 5A:
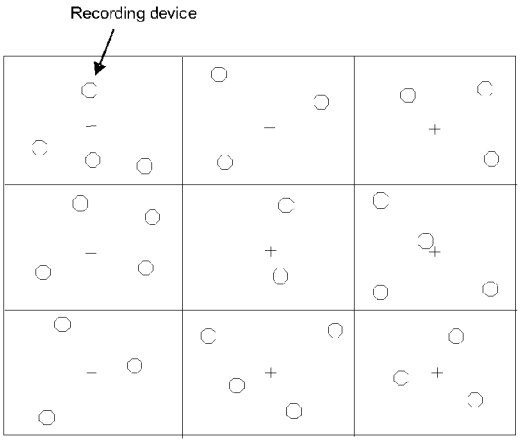

A more detailed operation of the zoomable events analysis unit 302 according to an embodiment is shown in FIG. 4 with reference to FIGS. 5*a*-5*d* illustrating the processing steps to obtain the zoomable audio points. First, the size of the overall audio scene is determined (402). The determination of the size of the overall audio scene may comprise the zoomable events analysis unit 302 selecting a size of the overall audio scene or the zoomable events analysis unit 302 may receive information regarding the size of the overall audio scene. The size of the overall audio scene determines how far away the zoomable audio points can locate with respect to the listening position. Typically, the size of the audio scene may span up to at least a few tens of meters depending on the number of recordings centering the selected listening position. Next, the audio scene is divided into a number of cells, for example into equal-size rectangular cells as shown in the grid of FIG. 5*a*. A cell suitable to subjected for an analysis is then determined (404) from the number of the cells. Naturally, the grid may be determined to comprise cells of any shapes and sizes. In other words, a grid is used divide an audio scene into a number of sub-sections, and the term cell is used here to refer to a sub-section of an audio scene.

According to an embodiment, the analysis grid and the cells therein are determined such that each cell of the audio scene comprises at least two sound sources. This is illustrated in the example of FIGS. 5*a*-5*d*, wherein each cell holds at least two recordings (marked as circle in FIG. 5*a*) at different locations. According to another embodiment, the grid may be determined in such a way that the number of sound sources in a cell does exceed a predetermined limit. According to yet another embodiment, a (fixed) predetermined grid is used wherein the number and the location of the sound sources within the audio scene is not taken into account. Consequently, in such an embodiment a cell may comprise any number of sound sources, including none.

Next, sound source directions are calculated for each cell, wherein the process steps 406-410 are repeated for a number of cells, for example for each cell within the grid. The sound source directions are calculated with respect to the center of a cell (marked as + in FIG. 5*a*). First, time-frequency (T/F) transformation is applied (406) to the recorded signals within the cell boundaries. The frequency domain representation may be obtained using discrete Fourier transform (DFT), modified discrete cosine/sine transform (MDCT/MDST), quadrature mirror filtering (QMF), complex valued QMF or any other transform that provides frequency domain output. Next, direction vectors are calculated (408) for each time-frequency tile. The direction vector described by polar coordinates indicates the sound events radial position and direction angle with respect to the forward axis.

To ensure computationally efficient implementation the spectral bins are grouped into frequency bands. As the human auditory system operates on a pseudo-logarithmic scale, such non-uniform frequency bands are preferably used in order to more closely reflect the auditory sensitivity of human hearing. According to an embodiment, the non-uniform frequency bands follow the boundaries of the equivalent rectangular bandwidth (ERB) bands. In other embodiments, different frequency band structure, for example one comprising frequency bands of equal width in frequency, may be used. The input signal energy for the recording n at the frequency band m over the time window T may be computed, for example, by $$e_{n,m} = \sqrt{\sum_{j=sbOffset[m]}^{sbOffset[m+1]-1} \sum_{t \in T} |\bar{f}_{t,n}(j)|^2} \tag{1}$$

where $\bar{f}_{t,n}$ is the frequency domain representation of $n^{th}$ recorded signal at time instant t. Equation (1) is calculated on a frame-by-frame basis where a frame represents, for example, 20 ms of signal. Furthermore, the vector sbOffset describes the frequency band boundaries, i.e. for each frequency band it indicates the frequency bin that is the lower boundary of the respective band. Equation (1) is repeated for $0 \le m < M$, where M is the number of frequency bands defined for the frame and for $0 \le n < N$, where N is the number of recordings present in the cell of the audio scene. Furthermore, the employed time window, that is, how many successive input frames are combined in the grouping, is described by $\bar{T}=\{t,t+1,t+2,t+3, \ldots\}$. Successive input frames may be grouped to avoid excessive changes in the direction vectors as perceived sound events typically do not change so rapidly in real life. For example a time window of 100 ms may be used to introduce a suitable trade off between stability of the direction vectors and accuracy of the direction modelling. On the other hand, time window of any length considered suitable for a given audio scene may be employed within embodiments herein.

Next, the perceived direction of a source within the time window T is determined for each frequency band m. The localization is defined as $$\text{alfa_r}_m = \frac{\sum_{n=0}^{N-1} e_{n,m} \cdot \cos(\phi_n)}{\sum_{n=0}^{N-1} e_{n,m}}, \quad \text{alfa_i}_m = \frac{\sum_{n=0}^{N-1} e_{n,m} \cdot \sin(\phi_n)}{\sum_{n=0}^{N-1} e_{n,m}} \tag{2}$$

where $\phi_n$ describes the recording angle of recording n relative to the forward axis within the cell.

As an example, FIG. 6 illustrates the recording angles for the bottom rightmost cell in FIG. 5*a*, wherein the three sound sources of the cell are assigned their respective recording angles $\phi_1$, $\phi_2$, $\phi_3$ relative to the forward axis.

The direction angle of the sound events in frequency band m for the cell is then determined as follows $$\theta_m = \angle(\text{alfa_}r_m, \text{alfa_}i_m) \tag{3}$$

Equations (2) and (3) are repeated for $0 \le m < M$, i.e. for all frequency bands.

Next, in the direction analysis (410) the direction vectors across the frequency bands within each cell are grouped to locate the most promising sound sources within the time window T. The purpose of the grouping is to assign frequency bands that have approximately the same direction into a same group. Frequency bands having approximately the same direction are assumed to originate from the same source. The goal of the grouping is to converge only to a small number of groups of frequency bands that will highlight the dominant sources present in the audio scene, if any.

Embodiments of the invention may use suitable criteria or process to identify such groups of frequency bands. In an embodiment of the invention, the grouping process (410) may be performed, for example, according to the exemplified pseudo code below.

```
0   dirDev = anglnc
1   nDirBands = M
2   For m=0 to nDirBands−1
3   nTargetDir_m = 1
4   targetDirVec_{nTargetDir_m−1}[m] = θ_m
5   targetEngVec_{nTargetDir_m−1}[m] = Σ_{k=0}^{N_g−1} e_{k,m}
6   endfor
7   idxRemoved_m = 0
8   eVec[m] = Σ_{k=0}^{nTargetDir_m−1} targetEngVec_k[m]
9   dVec[m] = 1/nTargetDir_m · Σ_{k=0}^{nTargetDir_m−1} targetDirVec_k[m]
10  arrange elements of vector eVec into decreasing order
    and arrange elements of vector dVec accordingly
11  nNewDirBands = nDirBands
12  For idx=0 to nDirBands−1
13    If idxRemoved_idx == 0
14    For idx2=idx+1 to nDirBands−1
15        If idxRemoved_idx2 == 0
16          If |dVec[idx] − dVec[idx2]| ≤ dirDev
17              idxRemoved_idx2 = 1
18              Append  targetDirVec_t[idx2]  to
    targetDirVec_{nTargetDir_idx+t}[idx]
19              Append  targetEngVec_t[idx2]  to
    targetEngVec_{nTargetDir_idx+t}[idx]
20              nTargetDir_idx = nTargetDir_idx + nTargetDir_idx2
21          nNewDirBands = nNewDirBands − 1
22        endif
23    endif
24  endfor
25  endif
26  endfor
27  nDirBands = nNewDirBands
28  dirDev = dirDev + anglnc
29  Remove entries that have been marked as merged into
    another group (idxRemoved_m == 1) from the following vector
    variables:
30    − nTargetDir_m
31    − targetDirVec_k[m]
32    − targetEngVec_k[m]
33  If nDirBands > nSources and iterRound < maxRounds
34    Goto line 7;
```

In the above described implementation example of the grouping process, the lines 0-6 initialize the grouping. The grouping starts with a setup where all the frequency bands are considered independently without any merging, i.e. initially each of the M frequency band forms a single group, as indicated by the initial value of variable nDirBands indicating the current number of frequency bands or groups of frequency bands set in line 1. Furthermore, vector variables $\text{nTargetDir}_m$, $\text{targetDirVec}_{nTargetDir_m^{-1}}$ [m] and $\text{targetEngVec}_{nTargetDir_m^{-1}}$[m] are initialized accordingly in lines 2-6. Note that in line 4, $N_g$ describes the number of recordings for the cell g.

The actual grouping process is described on lines 7-26. Line 8 updates the energy levels according to current grouping across the frequency bands, and line 9 updates the respective direction angles by computing the average direction angles for each group of frequency bands according to current grouping. Thus, the processing of lines 8-9 is repeated for each group of frequency bands (repetition not shown in the pseudo code). Line 10 sorts the elements of the energy vector eVec into decreasing order of importance, in this example in the decreasing order of energy level, and sorts the elements in direction vector dVec accordingly.

Lines 11-26 describe how the frequency bands are merged in the current iteration round and apply the conditions for grouping a frequency band into another frequency band or into a group of (already merged) frequency bands. Merging is performed, if a condition regarding the average direction angle of the current reference band/group (idx) and the average direction angle of the band to be tested for merging (idx2) meets predetermined criteria, for example, if the absolute difference between the respective average direction angles is less than or equal to dirDev value indicating the maximum allowed difference between direction angles considered to represent the same sound source in this iteration round (line 16), as used in this example. The order in which the frequency bands (or groups of frequency bands) are considered as a reference band is determined based on the energy of the (groups of) frequency bands, that is, the frequency band or the group of frequency bands having the highest energy is processed first, and the frequency band having the second highest energy is processed second and so on. If merging is be carried out, on the basis of the predetermined criteria, the band to be merged into the current reference band/group is excluded from further processing in line 17 by changing the value of the respective element of vector variable $idxRemoved_{idx2}$ to indicate this.

The merging appends the frequency band values to the reference band/group in lines 18-19. The processing of lines 18-19 is repeated for $0 \le t < nTargetDir_{idx2}$ to merge all frequency bands currently associated with idx2 to the current reference band/group indicated by idx (repetition is not shown in the pseudo code). The number of frequency bands associated with the current reference band/group is updated in line 20. The total number of bands present is reduced in line 21 to account for the band just merged with the current reference band/group.

Lines 5-25 are repeated until the number of bands/groups left is less than nSources and the number of iterations has not exceeded the upper limit (maxRounds). This condition is verified in line 33. In this example, the upper limit for the number of iteration rounds is used to limit the maximum amount of direction angle difference between the frequency bands still considered to represent the same sound source, i.e. still allowing the frequency bands to be merged into the same group of frequency bands. This may be a useful limitation, since it is unreasonable to assume that if the direction angle deviation between two frequency bands is relatively large that they would still represent the same sound source. In an exemplified implementation, the following values may be set: anglnc=2.5°, nSources=5, and maxRounds=8, but different values may be used in various embodiment The merged direction vectors for the cell are finally calculated according to $$dVec[m] = \frac{1}{nTargetDir_m} \cdot \sum_{k=0}^{nTargetDir_m - 1} targetDirVec_k[m] \tag{4}$$

Figure 5B:
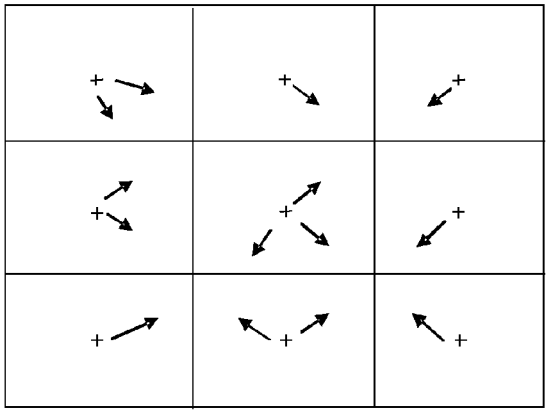

Equation (4) is repeated for $0 \le m < nDirBands$. FIG. 5*b* illustrates the merged direction vectors for the cells of the grid.

The following example illustrates the grouping process. Let us suppose that originally there are 8 frequency bands with the direction angle values of 180°, 175°, 185°, 190°, 60°, 55°, 65° and 58°. The dirDev value, i.e. the absolute difference between the average direction angle of the reference band/group and the band/group to be tested for merging is set to 2.5°.

On the $1^{st}$ iteration round, the energy vectors of the sound sources are sorted in a decreasing order of importance, resulting in the order of 175°, 180°, 60°, 65°, 185°, 190°, 55° and 58°. Further, it is noticed that the difference between the band having direction angle 60° and the frequency band having direction angle 58° remains within the dirDev value. Thus, the frequency band having direction angle 58° is merged with the frequency band having direction angle 60°, and at the same time it is excluded from further grouping, resulting in frequency bands having direction angles 175°, 180°, [60°, 58°], 65°, 185°, 190° and 55°, where the brackets are used to indicate frequency bands that form a group of frequency bands.

On the $2^{nd}$ iteration round, the dirDev value is increased by 2.5°, resulting in 5.0°. Now, it is noticed that the differences between the frequency band having direction angle 175° and the frequency band having direction angle 180°, the group of frequency bands having direction angles 60° and 58° and the frequency band having direction angle 55°, and the frequency band having direction angle 185° and the frequency band having direction angle 190°, respectively, all remain within the new dirDev value. Thus, the frequency band having direction angle 180°, the frequency band having direction angle 55° and the frequency band having direction angle 190° are merged with their counterparts and excluded from further grouping, resulting in frequency bands having direction angles [175°, 180°], [60°, 58°, 55°], 65° and [185°, 190°].

On the $3^{rd}$ iteration round, again the dirDev value is increased by 2.5°, resulting now in 7.5°. Now, it is noticed that the difference between the group of frequency bands having direction angles 60°, 58° and 55° and the frequency band having direction angle 65° remains within the new dirDev value. Thus, the frequency band having direction angle 65° is merged with the group of frequency bands having direction angles 60°, 58° and 55°, and at the same time it is excluded from further grouping, resulting in frequency bands [175°, 180°], [60°, 58°, 55°, 65°] and [185°, 190°].

On the $4^{th}$ iteration round, again the dirDev value is increased by 2.5°, resulting now in 10.0°. This time, it is noticed that the difference between the group of frequency bands having direction angles 175° and 180° and the group of frequency bands having direction angles 185° and 190° remains within the new dirDev value. Thus, these two groups of frequency bands are merged.

Consequently, in this grouping process two groups of four direction angles were found; $1^{st}$ group: [175°, 180°, 185° and 190°], and $2^{nd}$ group: [60°, 58°, 55° and 65°]. It is presumable that the direction angles within each group and having approximately the same direction originate from the same source. The average value dVec for the $1^{st}$ group is 182.5° and for the $2^{nd}$ group 59.5°. Accordingly, in this example, two dominant sound sources were found through grouping where the maximum direction angle deviation between bands/groups to be merged was 10.0°.

A skilled person appreciates that it is also possible that no sound sources are found from the audio scene, either because there are no sound sources or the sound sources in the audio scene are so scattered that clear separation between sounds cannot be made.

Figure 5C:
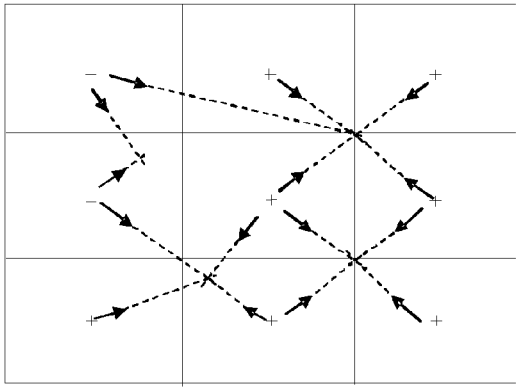
Figure 5D:
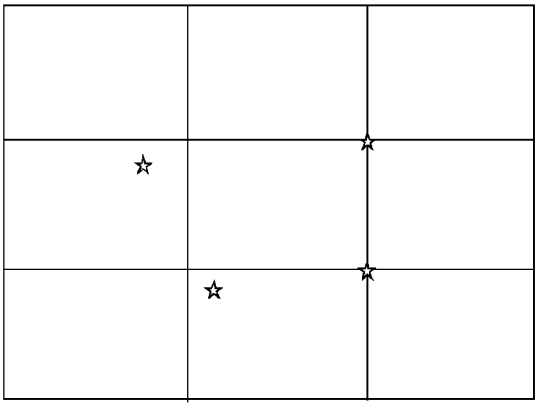

Referring back to FIG. 4, the same process is repeated (412) for a number of cells, for example of all the cells of the grid, and after all cells under consideration have been processed, the merged direction vectors for the cells of the grid are obtained, as shown in FIG. 5*b*. The merged direction vectors are then mapped (414) into zoomable audio points such that the intersection of the direction vectors is classified as a zoomable audio point, as illustrated in FIG. 5*c*. FIG. 5*d* shows the zoomable audio points for the given direction vectors as star figures. The information indicating the locations of the zoomable audio points within the audio scene is then provided (416) to the reconstruction side, as described in connection with FIG. 3.

A more detailed block diagram of the zoom control process at the rendering side, i.e. in the client device, is shown in FIG. 7. The client device obtains (700) the information indicating the locations of the zoomable audio points within the audio scene provided by the server or via the server. Next, the zoomable audio points are converted (702) into a user friendly representation whereafter a view of the possible zooming points in the audio scene with respect to the listening position is displayed (704) to user. The zoomable audio points therefore offer the user a summary of the audio scene and a possibility to switch to another listening location based on the audio points. The client device further comprises means for giving an input regarding the selected audio point, for example by a pointing device or through menu commands, and transmitting means for providing the server with information regarding the selected audio point. Through audio points, the user can easily follow the most important and distinctive sound sources that the system has identified.

According to an embodiment, the end user representation shows the zoomable audio points as an image where the audio points are shown in highlighted form, such as in clearly distinctive colors or in some other distinctively visible form. According to another embodiment, the audio points are overlaid in the video signal such that the audio points are clearly visible but do not disturb the viewing of the video. The zoomable audio points could also be showed based on the orientation of the user. If the user is, for example, facing north only audio points present in the north direction would be shown to the user and so on. In another variation of the audio points representation, the zoomable audio points could be placed on a sphere where audio points in any given direction would be visible to the user.

FIG. 8 illustrates an example of the zoomable audio points representation to the end user. The image contains two button shapes that describe the zoomable audio points that fall within the boundaries of the image and three arrow shapes that describe zoomable audio points and their direction that are outside the current view. The user may choose to follow the points to further explore the audio scene.

A skilled person appreciates that any of the embodiments described above may be implemented as a combination with one or more of the other embodiments, unless there is explicitly or implicitly stated that certain embodiments are only alternatives to each other.

FIG. 9 illustrates a simplified structure of an apparatus (TE) capable of operating either as a server or a client device in the system according to the invention. The apparatus (TE) can be, for example, a mobile terminal, a MP3 player, a PDA device, a personal computer (PC) or any other data processing device. The apparatus (TE) comprises I/O means (I/O), a central processing unit (CPU) and memory (MEM). The memory (MEM) comprises a read-only memory ROM portion and a rewriteable portion, such as a random access memory RAM and FLASH memory. The information used to communicate with different external parties, e.g. a CD-ROM, other devices and the user, is transmitted through the I/O means (I/O) to/from the central processing unit (CPU). If the apparatus is implemented as a mobile station, it typically includes a transceiver Tx/Rx, which communicates with the wireless network, typically with a base transceiver station (BTS) through an antenna. User Interface (UI) equipment typically includes a display, a keypad, a microphone and connecting means for headphones. The apparatus may further comprise connecting means MMC, such as a standard form slot for various hardware modules, or for integrated circuits IC, which may provide various applications to be run in the apparatus.

Accordingly, the audio scene analysing process according to the invention may be executed in a central processing unit CPU or in a dedicated digital signal processor DSP (a parametric code processor) of the apparatus, wherein the apparatus receives the plurality of audio signals originating from the plurality of audio sources. The plurality of audio signals may be received directly from microphones or from memory means, e.g. a CD-ROM, or from a wireless network via the antenna and the transceiver Tx/Rx. Then the CPU or the DSP carries out the step of analyzing the audio scene in order to determine zoomable audio points within the audio scene and information regarding the zoomable audio points is provided to a client device e.g. via the transceiver Tx/Rx and the antenna.

The functionalities of the embodiments may be implemented in an apparatus, such as a mobile station, also as a computer program which, when executed in a central processing unit CPU or in a dedicated digital signal processor DSP, affects the terminal device to implement procedures of the invention. Functions of the computer program SW may be distributed to several separate program components communicating with one another. The computer software may be stored into any memory means, such as the hard disk of a PC or a CD-ROM disc, from where it can be loaded into the memory of mobile terminal. The computer software can also be loaded through a network, for instance using a TCP/IP protocol stack.

It is also possible to use hardware solutions or a combination of hardware and software solutions to implement the inventive means. Accordingly, the above computer program product can be at least partly implemented as a hardware solution, for example as ASIC or FPGA circuits, in a hardware module comprising connecting means for connecting the module to an electronic device, or as one or more integrated circuits IC, the hardware module or the ICs further including various means for performing said program code tasks, said means being implemented as hardware and/or software.

It is obvious that the present invention is not limited solely to the above-presented embodiments, but it can be modified within the scope of the appended claims.

The invention claimed is:

1. A method comprising:

obtaining a plurality of audio signals originating from a plurality of audio sources in order to create an audio scene;

analyzing the audio scene in order to determine zoomable audio points within the audio scene; and providing information regarding the zoomable audio points to a client device for selecting, wherein analyzing the audio scene further comprises determining a size of the audio scene;

dividing the audio scene into a plurality of cells;

determining, for the cells comprising at least one audio source, at least one directional vector of an audio source for a frequency band of an input frame;

combining, within each cell, directional vectors of a plurality of frequency bands having a deviation angle less than a predetermined limit into one or more combined directional vectors; and determining intersection points of the combined directional vectors of the audio scene as the zoomable audio points.

2. The method according to claim 1, the method further comprising:

in response to receiving information on a selected zoomable audio point from the client device, providing the client device with an audio signal corresponding to the selected zoomable audio point.

3. The method according to claim 1, wherein the audio scene is divided into the plurality of cells such that each cell comprises at least two audio sources.

4. The method according to claim 1, wherein the audio scene is divided into the plurality of cells such that the number of audio sources in each cell is within a predetermined limit.

5. The method according to claim 1, wherein prior to determining the at least one directional vector the method further comprises transforming the plurality of audio signals into frequency domain; and dividing the plurality of audio signals in frequency domain into frequency bands complying with equivalent rectangular bandwidth scale.

6. A computer program product, stored on a computer readable medium that when executed causes an apparatus to perform a method according to claim 1.

7. The method according to claim 1, the method further comprising:

obtaining, in the client device, information regarding the zoomable audio points within the audio scene from a server;

representing the zoomable audio points on a display to enable selection of a preferred zoomable audio point; and in response to obtaining an input regarding a selected zoomable audio point, providing the server with information regarding the selected zoomable audio point.

8. An apparatus comprising at least one processor and at least one memory including computer program, the at least one memory and the computer program configured to, with the at least one processor, cause the apparatus at least to:

obtain a plurality of audio signals originating from a plurality of audio sources in order to create an audio scene;

analyze the audio scene in order to determine zoomable audio points within the audio scene; and provide information regarding the zoomable audio points to be accessible via a communication interface by a client device, wherein the apparatus is arranged to determine a size of the audio scene;

divide the audio scene into a plurality of cells;

determine, for the cells comprising at least one audio source, at least one directional vector of an audio source for a frequency band of an input frame;

combine, within each cell, directional vectors of a plurality of frequency bands having a deviation angle less than a predetermined limit into one or more combined directional vectors; and determine intersection points of the combined directional vectors of the audio scene as the zoomable audio points.

9. The apparatus according to claim 8, wherein:

in response to receiving information on a selected zoomable audio point from the client device, the apparatus is arranged to provide the client device with an audio signal corresponding to the selected zoomable audio point.

10. The apparatus according to claim 9, further comprising:

generate a downmixed audio signal corresponding to the selected zoomable audio point.

11. The apparatus according to claim 8, wherein the apparatus is arranged to divide the audio scene into the plurality of cells such that each cell comprises at least two audio sources.

12. The apparatus according to claim 8, wherein the apparatus is arranged to divide the audio scene into the plurality of cells such that the number of audio sources in each cell is within a predetermined limit.

13. The apparatus according to claim 8, wherein the apparatus is arranged to divide the audio scene into the plurality of cells using a predetermined grid of cells.

14. The apparatus according to claim 8, wherein the apparatus, when determining at least one directional vector, is arranged to determine input energy for each audio signal for said frequency band of the input frame for a selected time window; and determine a direction angle of an audio source on the basis of the input energy of said audio signal relative to a predetermined forward axis of the cell of the audio source.

15. The apparatus according to claim 8, wherein the apparatus, prior to determining the at least one directional vector is arranged to transform the plurality of audio signals into frequency domain; and divide the plurality of audio signals in frequency domain into frequency bands complying with equivalent rectangular bandwidth scale.

16. The apparatus according to claim 8, the apparatus is further arranged to obtain positioning information of the plurality of audio sources prior to creating the audio scene.

17. An system comprising the apparatus of claim 8 and the client device configured to, cause the client device at least to:

obtain information regarding zoomable audio points within an audio scene;

convert the information regarding the zoomable audio points into a form representable on a display to enable selection of a preferred zoomable audio point;

obtain an input regarding a selected zoomable audio point, and provide information regarding the selected zoomable audio points to be accessible via a communication interface by a server.

18. A computer program product, stored on a computer readable medium that when executed causes an apparatus to perform a method according to claim 7.

* * * * *

UNITED STATES PATENT AND TRADEMARK OFFICE

CERTIFICATE OF CORRECTION

PATENT NO. : 8,989,401 B2
APPLICATION NO. : 13/509262
DATED : March 24, 2015
INVENTOR(S) : Ojanperä

It is certified that error appears in the above-identified patent and that said Letters Patent is hereby corrected as shown below:

In the claims:

Column 12,
Line 47, "An system" should read --A system--.

Signed and Sealed this
First Day of December, 2015

Michelle K. Lee

Michelle K. Lee
*Director of the United States Patent and Trademark Office*